US011043727B2

(12) United States Patent
Salem et al.

(10) Patent No.: US 11,043,727 B2
(45) Date of Patent: Jun. 22, 2021

(54) SUBSTRATE INTEGRATED WAVEGUIDE MONOPULSE AND ANTENNA SYSTEM

(71) Applicant: Raytheon Company, Waltham, MA (US)

(72) Inventors: Matthew Salem, Tucson, AZ (US); Christopher Smith, Tucson, AZ (US); Michael D. Gordon, Tucson, AZ (US); Robert L. Sisk, III, Sahuarita, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 16/247,806

(22) Filed: Jan. 15, 2019

(65) Prior Publication Data

US 2020/0227808 A1 Jul. 16, 2020

(51) Int. Cl.
*H01Q 13/10* (2006.01)
*H01Q 1/38* (2006.01)
(Continued)

(52) U.S. Cl.
CPC ..... *H01P 5/19* (2013.01); *H01P 3/121* (2013.01); *H01Q 1/38* (2013.01); *H01Q 1/48* (2013.01);
(Continued)

(58) Field of Classification Search
CPC ..... H01P 5/19; H01P 3/121; H01Q 13/10; H01Q 1/38; H01Q 21/064; H01Q 21/0006; H01Q 15/02; H01Q 1/04
See application file for complete search history.

(56) References Cited

U.S. PATENT DOCUMENTS 3,230,483 A * 1/1966 Kinsey ..... H01P 5/181 333/114
3,771,158 A * 11/1973 Hatcher ..... H01Q 5/42 343/728
(Continued)

FOREIGN PATENT DOCUMENTS

WO WO 2007/036607 A1 4/2007

OTHER PUBLICATIONS

PCT International Preliminary Report dated May 9, 2019 for International Application No. PCT/US2017/027518; 10 Pages.
(Continued)

*Primary Examiner* — Graham P Smith
*Assistant Examiner* — Jae K Kim
(74) *Attorney, Agent, or Firm* — Daly, Crowley, Mofford & Durkee LLP

(57) ABSTRACT

Embodiments of the present disclosure relate to a substrate integrated waveguide monopulse antenna. The antenna comprises a substrate having first and second opposing surfaces. A first conductor is disposed on the first surface of the substrate. A plurality of antenna elements are provided on the first surface of the substrate. A second conductor is disposed on the second surface of the substrate. A plurality of conductive via holes extend through said substrate and extend between the first and second surfaces. The via holes are arranged to form a plurality of resonant cavities with at least one resonant cavity coupled to each of the antenna elements. The substrate also comprises a plurality of hybrid couplers, and two of the plurality of resonant cavities are coupled to at least one port of the plurality of hybrid couplers. A plurality of output couplers provided on the second surface of the substrate.

20 Claims, 5 Drawing Sheets

(51) Int. Cl.

| | |
|---|---|
| ***H01Q 1/48*** | (2006.01) |
| ***H01Q 21/06*** | (2006.01) |
| ***H01Q 21/00*** | (2006.01) |
| ***H01P 5/19*** | (2006.01) |
| ***H01P 3/12*** | (2006.01) |
| ***H01Q 15/02*** | (2006.01) |

(52) U.S. Cl.
CPC ..... *H01Q 13/10* (2013.01); *H01Q 15/02* (2013.01); *H01Q 21/0006* (2013.01); *H01Q 21/064* (2013.01)

(56) References Cited

U.S. PATENT DOCUMENTS 3,825,863 A 7/1974 Meier
3,832,716 A * 8/1974 Plunk ..... H01Q 13/106 343/770
3,974,462 A * 8/1976 Fassett ..... H01P 1/268 333/22 R
4,080,579 A * 3/1978 Fassett ..... H01P 1/268 333/117
4,096,482 A * 6/1978 Walters ..... H01Q 21/245 342/373
4,197,545 A * 4/1980 Favaloro ..... H01Q 13/106 343/700 MS
4,208,642 A 6/1980 Saunders
4,348,677 A * 9/1982 Salmond ..... H01Q 1/281 343/729
4,423,421 A * 12/1983 Peeler ..... H01Q 21/22 343/771
4,429,313 A * 1/1984 Muhs, Jr. ..... H01Q 21/005 343/771
4,434,541 A 3/1984 Powers, Jr.
4,684,952 A * 8/1987 Munson ..... H01Q 21/065 342/368
4,700,193 A * 10/1987 Sa ..... G01S 3/325 342/361
4,734,140 A 3/1988 Tzeng
4,932,673 A 6/1990 Domnikov et al.
5,208,561 A * 5/1993 Delestre ..... H01P 1/268 333/22 R
5,223,850 A * 6/1993 Branigan ..... H01Q 25/02 343/771
5,471,181 A 11/1995 Park
5,650,793 A * 7/1997 Park ..... H01Q 13/18 333/114
5,712,607 A 1/1998 Dittmer et al.
5,765,835 A 6/1998 Johnson
6,052,889 A 4/2000 Yu et al.
6,169,518 B1 * 1/2001 Nelson ..... G01S 7/02 342/149
6,545,572 B1 * 4/2003 Ohta ..... H01P 5/028 333/246
7,280,010 B2 * 10/2007 Buer ..... H01P 7/10 333/219.1
7,973,616 B2 * 7/2011 Shijo ..... H01P 5/182 333/113
8,931,738 B2 1/2015 White et al.
9,397,381 B2 * 7/2016 Kondou ..... H01P 5/028
9,408,306 B2 8/2016 Wang et al.
9,698,458 B2 7/2017 Stratis et al.
10,114,040 B1 10/2018 Jordan et al.
10,473,776 B2 * 11/2019 Di Palma ..... G01S 13/4463
2003/0067410 A1 * 4/2003 Puzella ..... H01Q 9/0407 343/700 MS
2003/0107451 A1 6/2003 Park
2003/0112576 A1 6/2003 Brewer et al.
2003/0210195 A1 * 11/2003 Hager ..... H01Q 13/18 343/770
2004/0048420 A1 3/2004 Miller
2006/0273863 A1 12/2006 Quan et al.
2007/0069839 A1 3/2007 Pathak et al.
2008/0088519 A1 4/2008 Quan et al.
2009/0158581 A1 6/2009 Nguyen et al.
2009/0179717 A1 7/2009 Sterns et al.
2009/0231226 A1 9/2009 Quan et al.
2011/0025429 A1 * 2/2011 Syal ..... H01P 3/081 333/34
2011/0115578 A1 5/2011 Quan et al.
2012/0045578 A1 * 2/2012 Di Fabrizio ..... B82Y 20/00 427/163.2
2012/0152454 A1 6/2012 Mass et al.
2012/0256794 A1 10/2012 Veihl et al.
2013/0057365 A1 * 3/2013 Mizushima ..... H05K 1/0251 333/238
2013/0241791 A1 * 9/2013 Anderson ..... H01Q 21/0081 343/848
2014/0015709 A1 * 1/2014 Shijo ..... H01P 5/12 342/195
2014/0028413 A1 1/2014 Ishii et al.
2016/0072190 A1 * 3/2016 Merk ..... H01Q 13/0266 343/776
2016/0240908 A1 * 8/2016 Strong ..... H05K 1/0239
2016/0286643 A1 9/2016 Taguchi et al.
2017/0026023 A1 1/2017 Simon et al.
2017/0062894 A1 3/2017 Stratis et al.
2017/0179562 A1 6/2017 Stratis et al.
2017/0229781 A1 8/2017 Morgan
2018/0115074 A1 4/2018 Wargo et al.
2020/0212531 A1 * 7/2020 Mai ..... H01P 1/20318

OTHER PUBLICATIONS

Response to Final Office Action dated Sep. 26, 2018 and Advisory Action dated Dec. 12, 2018 for U.S. Appl. No. 15/334,738; Response filed Jan. 28, 2019; 7 Pages.
Supplemental Response to Final Office Action dated Sep. 26, 2018 and Advisory Action dated Dec. 12, 2018 for U.S. Appl. No. 15/334,738; Supplemental Response filed Jan. 30, 2019; 13 Pages.
Cheng et al., "94 GHz Substrate Integrated Monopulse Antenna Array;" IEEE Transactions on Antennas and Propagation, vol. 60, No. 1; Jan. 2012; 9 Pages.
Bialkowski, et al.; "Reflectarrays: Potentials and Challenges"; International Conference on Electromagnetics in Advanced Applications, 2007; Sep. 17-21, 2007; 4 Pages.
Chen, et al.; "Optimization of Aperture Transitions for Multiport Microstrip Circuits"; IEEE Transactions on Microwave Theory and Techniques; vol. 44, No. 12; Dec. 1996; 9 Pages.
Roasto, et al.; "EMC Considerations on PCB Design for a High-Power Converter Control System"; Compatibility in Power Electronics; May 29-Jun. 1, 2007; 4 Pages.
PCT Search Report & Written Opinion of the ISA dated Jul. 20, 2017 from International Application No. PCT/US2017/027518; 17 Pages.
U.S. Non-Final Office Action dated Feb. 28, 2018 for U.S. Appl. No. 15/334,738; 20 Pages.
Response to U.S. Non-Final Office Action dated Feb. 28, 2018 for U.S. Appl. No. 15/334,738; Response filed May 22, 2018; 12 Pages.
U.S. Final Office Action dated Sep. 26, 2018 for U.S. Appl. No. 15/334,738; 21 Pages.
Response to U.S. Final Office Action dated Sep. 26, 2018 for U.S. Appl. No. 15/334,738; Response filed Nov. 26, 2018; 13 Pages.
U.S. Advisory Action dated Dec. 12, 2018 for U.S. Appl. No. 15/334,738; 3 Pages.
Notice of Allowance dated Mar. 20, 2019 for U.S. Appl. No. 15/334,738; 15 Pages.
Response filed on Dec. 12, 2019 for European Application No. 17719148.3; 17 Pages.
Examination Report dated Mar. 5, 2021 for European Application No. 17719148.3; 6 Pages.

* cited by examiner

SUBSTRATE INTEGRATED WAVEGUIDE MONOPULSE AND ANTENNA SYSTEM

BACKGROUND

As is known in the art, some monopulse radar systems utilize analog monopulse antenna systems comprising multi-layer printed circuit boards (PCBs). The multi-layer PCBs include substrate cores and layers which are bonded together. For example, such PCBs can have a six (6)-layer, (4) core multi-layer configuration. The PCBs also include external multiple radio frequency (RF) connectors (e.g. GPPO connectors) to allow coupling with a transceiver and other circuitry.

As is also known, as the number of layers in the PCB increases, the cost to fabricate monopulse antenna systems increases along with the volume they occupy. Additionally, multi-layer PCB monopulse antenna system designs typically include a series of conductive vias (or more simply "vias"). In such designs, some vias can extend through some layers and others can extend through all the layers of the PCB. Such designs increase manufacturing complexity and thus increase manufacturing time and expense. Further, such multi-layer PCB monopulse circuits often utilize external RF connectors which add to the cost and footprint of the monopulse antenna systems.

SUMMARY

This Summary is provided to introduce a selection of concepts in simplified form that are further described below in the Detailed Description. This Summary is not intended to identify key or essential features or combinations of the claimed subject matter, nor is it intended to be used to limit the scope of the claimed subject matter.

Described herein is a substrate having a monopulse waveguide circuit integrated therein. A substrate integrated waveguide monopulse antenna allows for a monopulse antenna system in a single substrate layer configuration.

In one aspect, a substrate integrated waveguide monopulse antenna comprises, a substrate having first and second opposing surfaces, a plurality of antenna elements disposed on one of the substrate surfaces, and a plurality of conductive vias disposed through the substrate to form a plurality of hybrid couplers, and a plurality of output couplers. The hybrid couplers are arranged such that they are capable of providing signals to and receiving signals from the antenna elements. Further the hybrid couplers are arranged around a perimeter of a substrate and configured to form a radio frequency (RF) "wrap-around" monopulse circuit.

In embodiments, the plurality of output couplers are coupled to one or more outputs and the plurality of output couplers are capable of providing signals to/from one or more outputs of the substrate integrated waveguide monopulse antenna to/from the hybrid couplers. Thus, the plurality of output couplers provide a means for providing signals to/from the substrate integrated waveguide monopulse antenna.

In embodiments, the plurality of antenna elements are provided on the first surface of the substrate. In embodiments, the plurality of antenna elements are provided on the second surface of the substrate. In embodiments, the plurality of conductive via holes extend through said substrate and extend between the first and second surfaces of said substrate. The plurality of conductive via holes are also arranged to form a plurality of resonant cavities with at least one resonant cavity coupled to each of the antenna elements such that the resonant cavities are capable of providing RF signals to and/or receiving RF signals from the antenna elements. The conductive vias form the plurality of hybrid couplers within the substrate and in embodiments, two of the plurality of resonant cavities are coupled to at least one port of the plurality of hybrid couplers. In embodiments The plurality of output couplers are provided on the second surface of the substrate.

In embodiments, a first conductive material can be disposed on the first surface of said substrate and can correspond to a conductive layer disposed on the first surface of said substrate. The plurality of antenna elements can be provided as slot antenna elements formed in the first conductive layer. The plurality of slot antenna elements can include a plurality of dogbone couplers.

The plurality of output couplers can be slotted output couplers. The second conductor on the second surface of the substrate can correspond to a ground plane layer. Each output coupler can be coupled to at least one port of said plurality of hybrid couplers.

The substrate integrated waveguide monopulse antenna can further comprise a transceiver that has first and second opposing surface. At least a portion of the first surface of the transceiver can be configured to couple to at least one of the plurality of output couplers.

The second surface of the substrate can be configured to lie flat on the first surface of the transceiver when the at least said portion of the first surface of the transceiver is coupled to said at least one of the plurality of output couplers.

The transceiver can be disposed under the second surface of the substrate.

In another aspect, a substrate integrated waveguide monopulse antenna comprises a substrate, a first conductive layer, a second conductive layer, a plurality of conductive via holes, and a plurality of slotted output couplers. The substrate has first and second opposing surface. A first side of the substrate is configured to couple with a seeker antenna comprising a plurality of slot antennas. The seeker antenna can further comprise a dichroic lens and a dish. The first conductive layer is disposed on the first surface of said substrate and is configured to receive the plurality of slot antenna elements. A second conductive layer is disposed on the second surface of said substrate. A plurality of conductive via holes extend through the substrate and extend between the first and second conductive layers. The plurality of via holes are arranged to form a plurality of resonant cavities and a plurality of hybrid couplers. At least one resonant cavity is coupled to each of said slot antenna elements. The plurality of slotted output couplers are provided in the second conductive layer. Two of the plurality of resonant cavities are coupled to at least one port of said plurality of hybrid couplers. Each slotted output coupler can be coupled to at least one port of said plurality of hybrid couplers.

The substrate integrated waveguide monopulse antenna can further comprise a transceiver. The transceiver can have first and second opposing surfaces, and at least a portion of the first surface of the transceiver can be configured to couple to at least one of the plurality of slotted output couplers. The transceiver can be disposed under the second surface of the substrate.

The second surface of substrate can be configured to lie flat on the first surface of the transceiver when the at least said portion of the first surface of the transceiver is coupled to said at least one of the plurality of slotted output couplers.

In an additional aspect, a substrate integrated waveguide monopulse antenna comprises a substrate, a first conductive layer, a plurality of slot antenna elements, a second conductive layer, and a plurality of conductive via holes. The substrate has first and second opposing surfaces. The first conductive layer is disposed on the first surface of said substrate. The plurality of slot antenna elements is provided in the first conductive layer. The second conductive layer is disposed on the second surface of said substrate. The plurality of conductive via holes extend through the substrate and extend between the first and second conductive layers. The plurality of conductive via holes are also arranged to form a plurality of resonant cavities and a plurality of hybrid couplers. The plurality of conductive via holes are further arranged to couple at least one resonant cavity to at least one port of a hybrid coupler.

A plurality of slotted output couplers can be provided in the second conductive layer. The plurality of conductive via holes can be further arranged to couple at least one slotted output coupler to at least one other port of a hybrid coupler.

The substrate integrated waveguide monopulse antenna can also comprise a transceiver that includes first and second opposing surfaces. At least a portion of the first surface of the transceiver is configured to couple to at least one of the plurality of slotted output couplers. The transceiver can be disposed under the second surface of the substrate.

The second surface of substrate can be configured to lie flat on the first surface of the transceiver when the at least said portion of the first surface of the transceiver is coupled to said at least one of the plurality of slotted output couplers.

BRIEF DESCRIPTION OF THE DRAWINGS

The foregoing and other objects, features and advantages will be apparent from the following more particular description of the embodiments, as illustrated in the accompanying drawings in which like reference characters refer to the same parts throughout the different views. The drawings are not necessarily to scale, emphasis instead being placed upon illustrating the principles of the embodiments.

DETAILED DESCRIPTION

Described herein is a monopulse antenna system having a waveguide monopulse integrated into a substrate to provide a "substrate integrated waveguide monopulse antenna." The system utilizes a "wrap-around" monopulse network and slotted output couplers to interface with a transceiver. It should be appreciated that to promote clarity in the description of the broad concepts, systems and techniques sought to be protected, the systems and techniques have been substantially described in the context of a configuration with slot antenna elements. It is, of course, recognized that the concepts, systems and techniques may operate with other types of antenna elements provided in a layer of the substrate.

Figure 1:
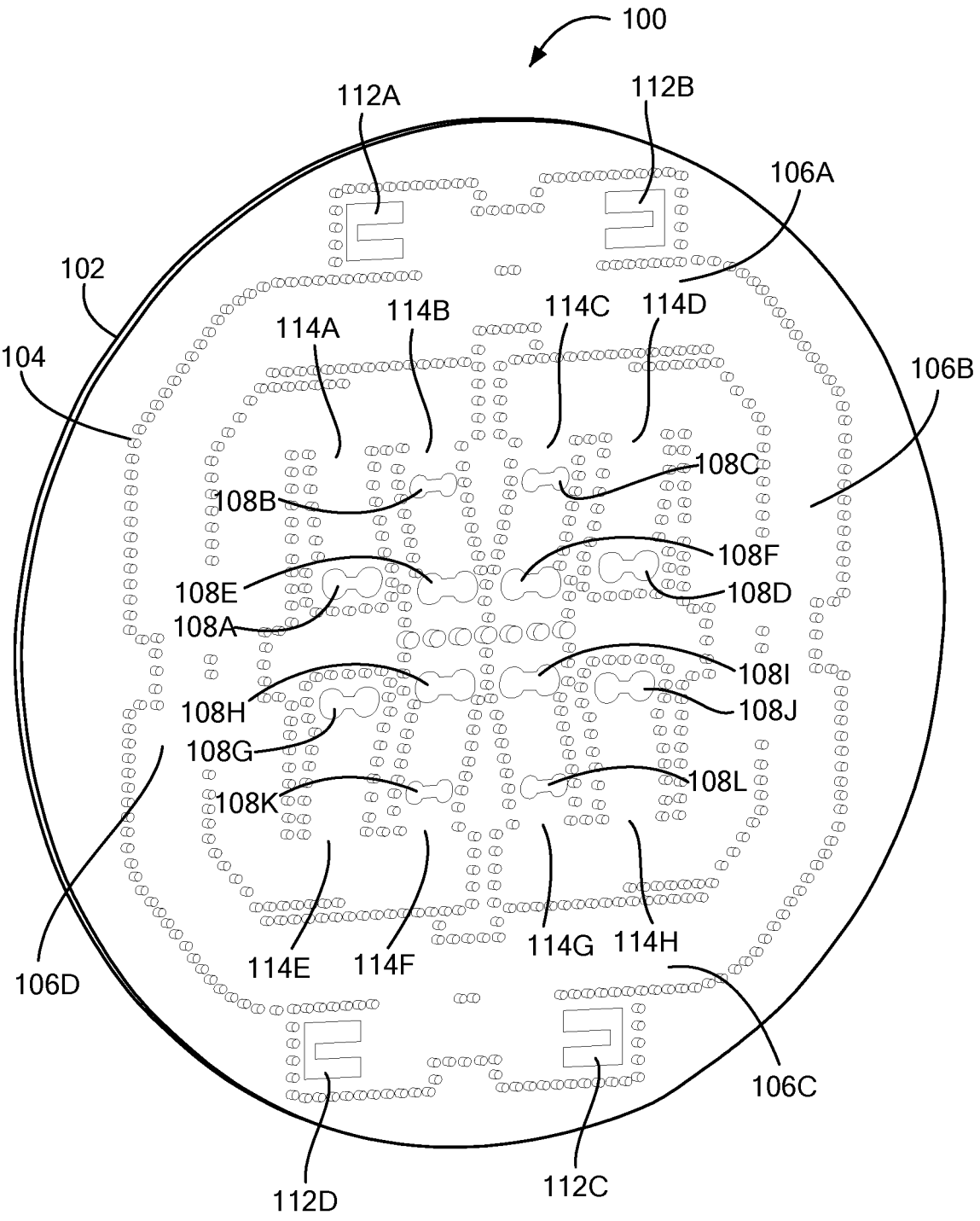
FIG. 1 is a transparent top view of a substrate integrated waveguide monopulse antenna system, according to some embodiments.

Referring now to FIG. 1, a substrate integrated waveguide monopulse antenna system 100 includes a single substrate 102. In embodiments, the substrate 102 can be a single monolithic substrate. In alternate embodiments, the substrate can be formed from a plurality of substrates (i.e. a multi-layer substrate) which are bonded or otherwise joined together so as to form or otherwise provide an integrated substrate structure corresponding to the single substrate 102. The substrate 102 includes first and second, opposing surfaces 102*a*, 102*b* with opposite, opposing sides 103*a*, 103*b*, 103*c*, 103*d* and a thickness. In embodiments, the thickness is based on desired frequency and bandwidth characteristics of the substrate integrated waveguide monopulse antenna system 100. In other embodiments, a height (i.e., thickness) of the waveguide system 100 is selected to provide a desired impedance range with minimal loss. In further embodiments, a width, via spacing, of the waveguide system 100 is selected based on a desired frequency/bandwidth and electrical impedance.

It should be appreciated that to promote clarity in the description of the concepts disclosed herein, FIG. 1 is presented as a transparent top view of a substrate integrated waveguide monopulse antenna system 100. Thus, all layers of the substrate 102 are visible.

In some embodiments, the opposing surfaces of the substrate 102 may have a rounded shape with various foci, radii, and diameters—e.g. circles, ovals, ellipses, to name a few. In other embodiments, the opposing surfaces of the substrate 102 may have polygonal shape with various sides, widths, lengths, and angles—e.g. triangle, square, rectangle, to name a few. In the illustrative embodiment of FIG. 1, the substrate 102 is provided having a circular shape, resulting in the circular top view depicted in FIG. 1. According to some embodiments, each opposing surface 102*a*, 102*b* of substrate 102 may have a conductive layer disposed thereon.

Substrate integrated waveguide monopulse and antenna system 100 also includes one or more slot antenna elements 108 provided in a first conductive layer disposed over the first surface 102*a* of substrate 102. Each slot antenna element 108 corresponds to an antenna element provided from one or more holes, or slots formed in the substrate. In the illustrative embodiments of FIG. 1 system 100 includes slot antennas 108A-J, while in other embodiments, system 100 may include a different number of slot antennas 108.

Slot antennas 108 are configured, at a first time, to transmit a desired radiation pattern, or transmit beam, according to transmit signals provided to system 100 by a transceiver or other signal source. When transmitting, each slot antenna 108 emits at least a portion of the desired transmit signal in accordance with a transmit beam. Slot antennas 108 are further configured, at a second time, to provide a receive beam. The receive beam receives at least a portion (or an "echo"), of the transmit beam. For example, the receive beam may receive a portion of a transmit signal that has been reflected or otherwise redirected from an object (e.g. a target or other structure). After receiving the receive signal at the slot antennas 108, the signals are provided to a monopulse circuit. The monopulse circuit will be described in further detail below with reference to FIGS. 2, 3, and 4.

Substrate integrated waveguide monopulse and antenna system 100 further includes conductive via holes 104. Conductive vias 104 pass through a first conductive layer disposed over a first surface 102*a* of substrate 102 and extend through substrate 102 to terminate at a second conductive layer disposed over a second, opposing surface 102*b* of substrate 102. In some embodiments, conductive via holes 104 extend straight through the substrate 102 (i.e. at an angle of ninety (90) degrees relative to the substrate surface), while in other embodiments conductive via holes 104 extend through the substrate in different angles. In the illustrative embodiment of FIG. 1 conductive via holes 104 extend straight through substrate 102.

Conductive vias 104 extending through substrate 102 are arranged to form at least one via fence. A via fence encompasses rows of via holes 104 spaced apart so as to form an impediment (and ideally a complete barrier or wall) to electromagnetic waves propagating in the substrate. Thus, conductive vias 104 can be used to direct (or channel) the electromagnetic waves in a desired direction.

Consequently, the at least one via fence is arranged to form a monopulse circuit comprising at least one 90° hybrid coupler 106 and to form at least one resonant cavity within substrate 102. In the illustrative embodiment of FIG. 1, conductive via holes 104 are arranged into via fences that form a monopulse circuit comprising 90° hybrid couplers 206A-D and also form resonant cavities 114A-H in substrate 102.

Resonant cavities 114 comprise via fences arranged as to allow electromagnetic waves (i.e. radio frequency (RF) signals) to propagate oscillate between the via fences. As the RF signals propagate within the resonant cavity, electromagnetic waves at the predetermined resonant frequency of the resonant cavity are reinforced to produce standing waves at the predetermine resonant frequency of the resonant cavity.

The vias are also arranged to provide 90° hybrid couplers 106 through which RF signals propagate. Once the RF signals are received, each 90° hybrid coupler 106 are configured to process the RF signals provided thereto to generate and output a sum, azimuth difference, elevation difference, diagonal difference (also referred to as a Q difference), or any combination thereof as detailed in the discussion of FIG. 3.

Conductive vias 104 are further arranged to form signal paths (e.g. waveguide signal paths) that couple each resonant cavity 114 to at least one port of a 90° hybrid coupler 106 of the monopulse circuit. The signal paths coupling each resonant cavity 114 to at least one port of a 90° hybrid coupler 106 are provided from "fences" of vias (i.e. "via fences") arranged through which RF signals may be directed from the port of 90° hybrid coupler 106 to resonant cavity 114 or directed from resonant cavity 114 to the port of 90° hybrid coupler 106.

Substrate integrated waveguide monopulse antenna 100 also comprises at least one slotted output coupler 112 provided in a second conductive layer disposed over a second opposite, opposing surface 102*b* of substrate 102. Slotted output couplers 112 may include electroconductive contacts provided within the second conductive layer, an exposed portion of the second conductive layer, or a cutout of the second conductive layer. In the illustrative embodiment of FIG. 1, system 100 includes slotted output couplers 112A-D, however, in other embodiments, system 100 may include a different number of slotted output couplers 112.

Figure 5:
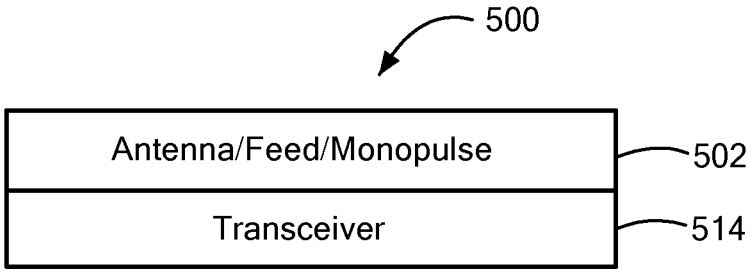
FIG. 5 is a block diagram illustrating a substrate integrated waveguide monopulse antenna system coupled to a transceiver, according to some embodiments.

Slotted output couplers 112 are configured to couple with a transceiver or other signal source as detailed in the discussion of FIG. 5. Each slotted output coupler 112 is configured to couple the at least one port of at least one of 90° hybrid output coupler 108 of the monopulse circuit to a transceiver or other circuit component. This coupling allows sum, azimuth difference, elevation difference, Q difference—or any combination thereof—signals formed by the monopulse circuit to be coupled between the monopulse and a transceiver or other circuit component (e.g. a transmitter). According to an embodiment, each slotted output coupler 112 may be provided by removing portions of the second conductive layer that form a port of at least one hybrid coupler 112. It should, however, be appreciated that any additive or subtractive technique may be used to form the output couplers. Similarly, all circuit components described herein may be provided by any additive or subtractive technique.

Figure 2:
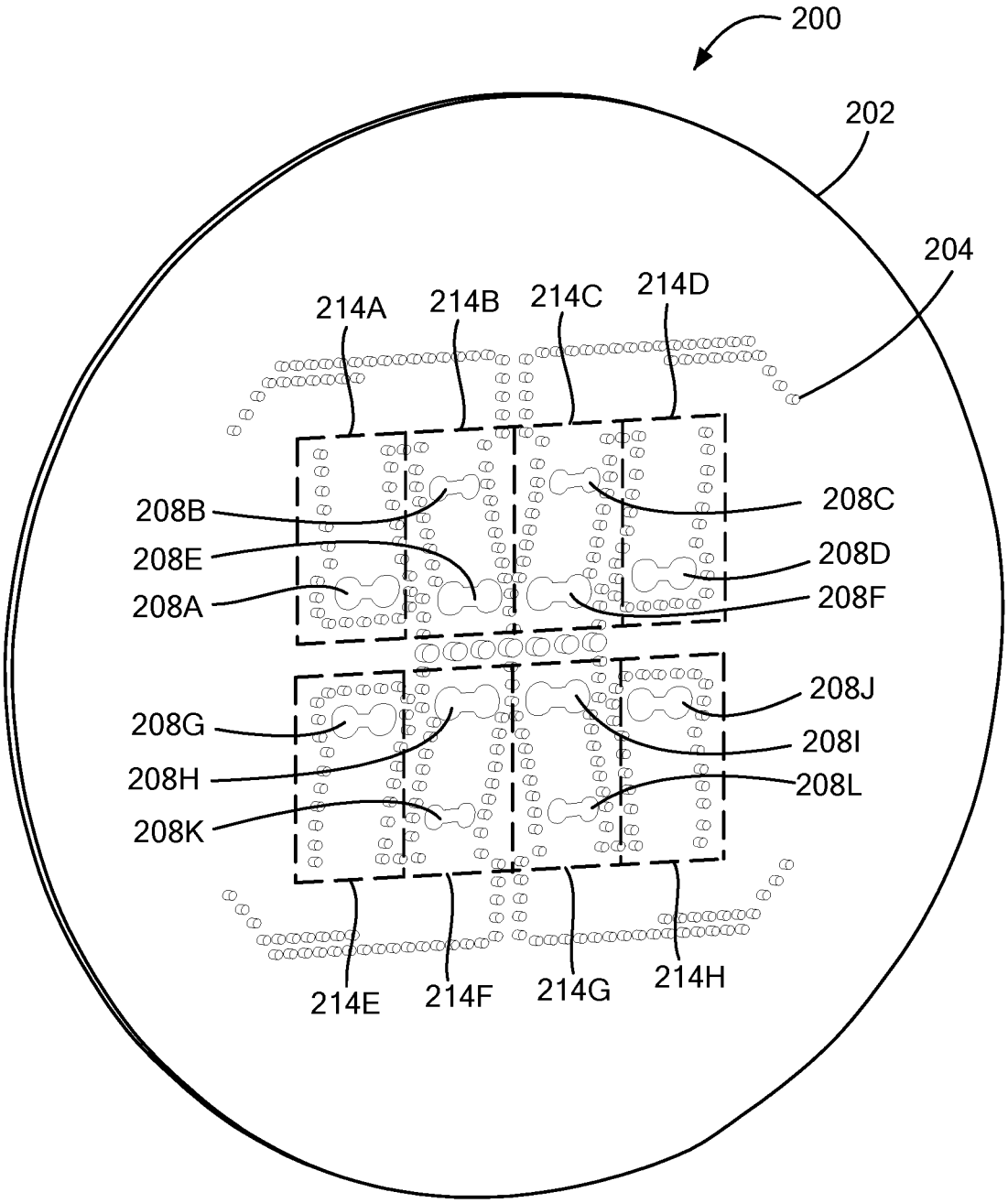
FIG. 2 is a top view of an antenna feed network for a substrate integrated waveguide monopulse antenna system, according to some embodiments.

Referring now to FIG. 2, an antenna feed network 200 has first and second opposing surfaces 200*a*, 200*b* with slot antennas 208 provided in a first conductive layer disposed over first surface 200*a* of substrate 202. It should be noted that the conductivity layer disposed over the first surface of substrate 200 corresponds to surface 102*a* of a substrate 202. Conductive via holes 204 extend through the substrate 202 and are arranged to form at least one resonant cavity 214. It should be noted that in the illustrative embodiment of FIG. 2, only the layers of substrate 202 including conductive via holes 204, slot antennas 208, and resonant cavities 214 are presented for clarity.

The antenna feed network 200 includes at least one slot antenna 208 situated within each resonant cavity 214 formed by conductive vias 204. In other words, at least one slot antenna 208 is provided in the first conductive layer disposed over a first surface of substrate 202 so that it is surrounded by the conductive vias 204 arranged to form a resonant cavity 214. While in the illustrative embodiment of FIG. 2, the feed network 200 includes eight resonant cavities 214A-H and 8 slot antennas 208A-H, in other embodiments, feed network 200 may include a different number of resonant cavities 214 and slot antennas 208. Further, while the illustrative embodiment of FIG. 2 depicts a configuration with one slot antenna (208A, 208D, 208G, and 208J) situated within four resonant cavities (214A, 214D, 214E, and 214H respectfully) and two slot antennas (208B and 208E, 208C and 208F, 208H and 208K, and 208I and 208L) situated within another four resonant cavities (214B, 214C, 214F, and 214G respectfully), in other embodiments different configurations may be used with a different number of slot antennas 208 within a different number of resonant cavities 214.

As discussed with reference to FIG. 1 above, integrated monopulse antenna system 100 may be used in either a transmit or receive mode. Thus, during a transmit operation a transmit signal is provided to the antennas 208 (e.g. via a transmit path of the monopulse circuit) to emit a desired radiation pattern. Similarly, in a receive mode of operation, each slot antenna 208 receives reflected portions of the desired transmit signal and couples the received signals through the resonant cavity 214 in which the slotted antenna 208 is situated.

For example, in the illustrative embodiment of FIG. 2, slot antenna 208A is configured to emit a portion of a desired transmit signal provided thereto via resonant cavity 214A.

The portions of the desired transmit signal are further provided to each resonant cavity 214 by the monopulse circuit. Each resonant cavity 214 receives portions of the desired transmit signal from at least one 90° hybrid coupler 106 of the monopulse circuit as detailed in the discussion with reference to FIGS. 3 and 4 below.

Similarly, in a receive mode of operation, each slot antenna 208 is configured to couple received signals to the resonant cavity 214 to which the slot antenna 208 is coupled. For example, in the illustrative embodiment of FIG. 2, slot antenna 208A is configured to couple received signals to resonant cavity 214A.

Once the resonant cavities 214 have received the signals provided thereto from a respective slot antenna 208, a standing wave at the resonant frequency of the resonant cavity 214 is produced. The standing waves formed or otherwise produced by each resonant cavity 214 correspond to the receive signals from respective slot antennas 208 (i.e. the slot antennas 208 coupled to ones of resonant cavities 214). The RF energy is coupled to the monopulse circuit. In particular, the received RF signals are coupled from respective ones of the resonant cavities to at least one port of respective ones of circuit elements which comprise the monopulse circuit (e.g. a 90° hybrid coupler, a 0°/180° coupler or any other circuit elements which may be appropriately coupled to form a monopulse circuit). A 90° hybrid coupler will be discussed in further detail below with regards to FIG. 3.

Figure 3:
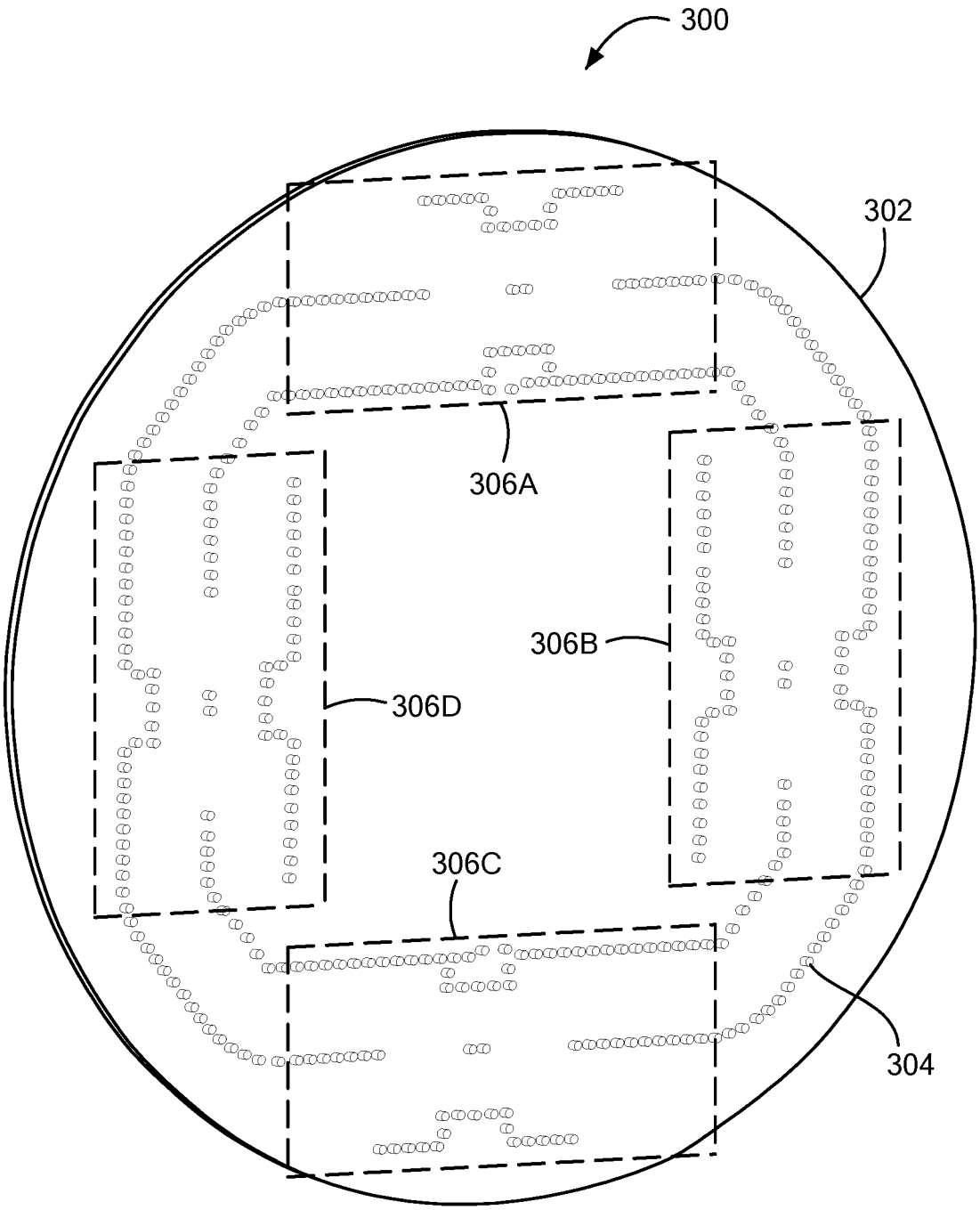
FIG. 3 is a top view of a wraparound monopulse for a substrate integrated waveguide monopulse antenna system, according to some embodiments.

Referring now to FIG. 3, substrate integrated waveguide monopulse antenna system 300 includes a monopulse substrate 302 in which at least portions of at least one monopulse circuit are provided. In the illustrative embodiment described herein, a monopulse circuit comprises four 90° hybrid couplers 306 formed from conductive via holes 304 extending through substrate 302. Those of ordinary skill in the art will recognize that although in this illustrative embodiment the monopulse circuit comprises four 90° hybrid couplers 306, other components and configurations may of course also be used.

Of course, as described herein by provided the monopulse as described herein, the advantages of a compact substrate integrated waveguide monopulse and antenna system are provided.

It should also be noted that in the illustrative embodiment of FIG. 3, only layers of substrate 302 including a monopulse circuit comprising conductive via holes 304 and 90° hybrid couplers 306 are shown for clarity. It should also be understood that within a monopulse circuit, conductive via holes 304 arranged to form each 90° hybrid coupler with each coupler having four ports configured to provide or receive electromagnetic signals to or from the monopulse circuit. For example, 90° hybrid coupler 306A comprises a first port 307A, a second port 309A, a third port 311A, and a fourth port 313A. According to some embodiments, each 90° hybrid coupler 306 comprises a first adjacent pair of ports 307, 309 located at a first end of 90° hybrid coupler 306 and a second adjacent pair of ports 311, 313 located at a second, opposite end of 90° hybrid coupler. For example, 90° hybrid coupler 306A comprises a first pair of ports 307A, 309A at a first side of 90° hybrid coupler 306A and a second pair of ports 311A, 313A at a second, opposite side of 90° hybrid coupler 306. In some embodiments, each adjacent port pair of 90° hybrid coupler 306 may share a via fence formed from conductive via holes 304.

The monopulse substrate 302 includes at least one 90° hybrid coupler 306 having at least one port 309 coupled to at least one resonant cavity 214 and at least one port 313 coupled to at least one other resonant cavity 214. For example, referring to the illustrative embodiment of FIG. 1, a first port of 90° hybrid coupler 106D is coupled to resonant cavities 114A and 114B and a second port at a second, opposite side of 90° hybrid coupler 106D is coupled to resonant cavities 114E and 114F.

Further, the 90° hybrid coupler 306 includes at least one port 307 coupled to a port of at least one other 90° hybrid coupler 306 and another port 311 coupled to a port of a further, distinct 90° hybrid coupler 306 (i.e. a 90° hybrid coupler 306 different from the 90° hybrid coupler coupled to the first side). For example, in the illustrative embodiment of FIG. 1, a port of 90° hybrid coupler 106D is coupled to a port of 90° hybrid coupler 106A and a port of 90° hybrid coupler 106D is coupled to a port of 90° hybrid coupler 106C.

The monopulse circuit also includes at least one other 90° hybrid coupler 306 with a port 307 coupled to at least one slotted output coupler and a port 311 coupled to at least one other slotted input/output coupler. For example, in the illustrative embodiment of FIG. 1, a port of 90° hybrid coupler 106C is coupled to slotted output coupler 112D and a port of 90° hybrid coupler 106C is coupled to slotted input/output coupler 112C.

According to some embodiments, slotted input/output couplers 112 coupled to 90° hybrid couplers 306 may be provided in a second conductive layer disposed over a second surface 302*b* of substrate 302. The slotted input/output couplers 112 are arranged in the second conductive layer such that they are surrounded by the conductive via holes 304 that form the 90° hybrid couplers 306 to which the slotted input/output couplers 112 are coupled. In other words, in the second conductive layer, slotted couplers 112 are located with via holes 304 that form a coupled 90° hybrid coupler. For example, in the illustrative embodiment of FIG. 1, slotted receiver 112A is arranged on substrate 102 so that it is surrounded by the conductive via holes 104 that form 90° hybrid coupler 106A.

Further, the other 90° hybrid coupler 306 includes at least one port 309 coupled to a port of at least one other 90° hybrid coupler 306 and another port 313 coupled to a port of a different, distinct 90° hybrid coupler 306 (i.e. a 90° hybrid coupler 306 different from the 90° hybrid coupler coupled to the first side). For example, in the illustrative embodiment of FIG. 1, a port of 90° hybrid coupler 106C is coupled to a port of 90° hybrid coupler 106D and a port of 90° hybrid coupler 106C is coupled to a port of 90° hybrid coupler 106B.

As discussed above in reference to FIG. 1, RF signals are coupled between the antenna elements and the monopulse circuit via resonant cavities 214. In response to signals provided thereto from the antenna elements (e.g. in response to receive signals) the monopulse circuit generates signals representing a sum, azimuth difference, elevation difference, Q difference. These signals, representing a sum, azimuth difference, elevation difference, Q difference—or any combination thereof, are provided to at least one slotted couplers 112 coupled to the monopulse circuit for output. The monopulse circuit, generates these sum and difference as is generally known.

Figure 4:
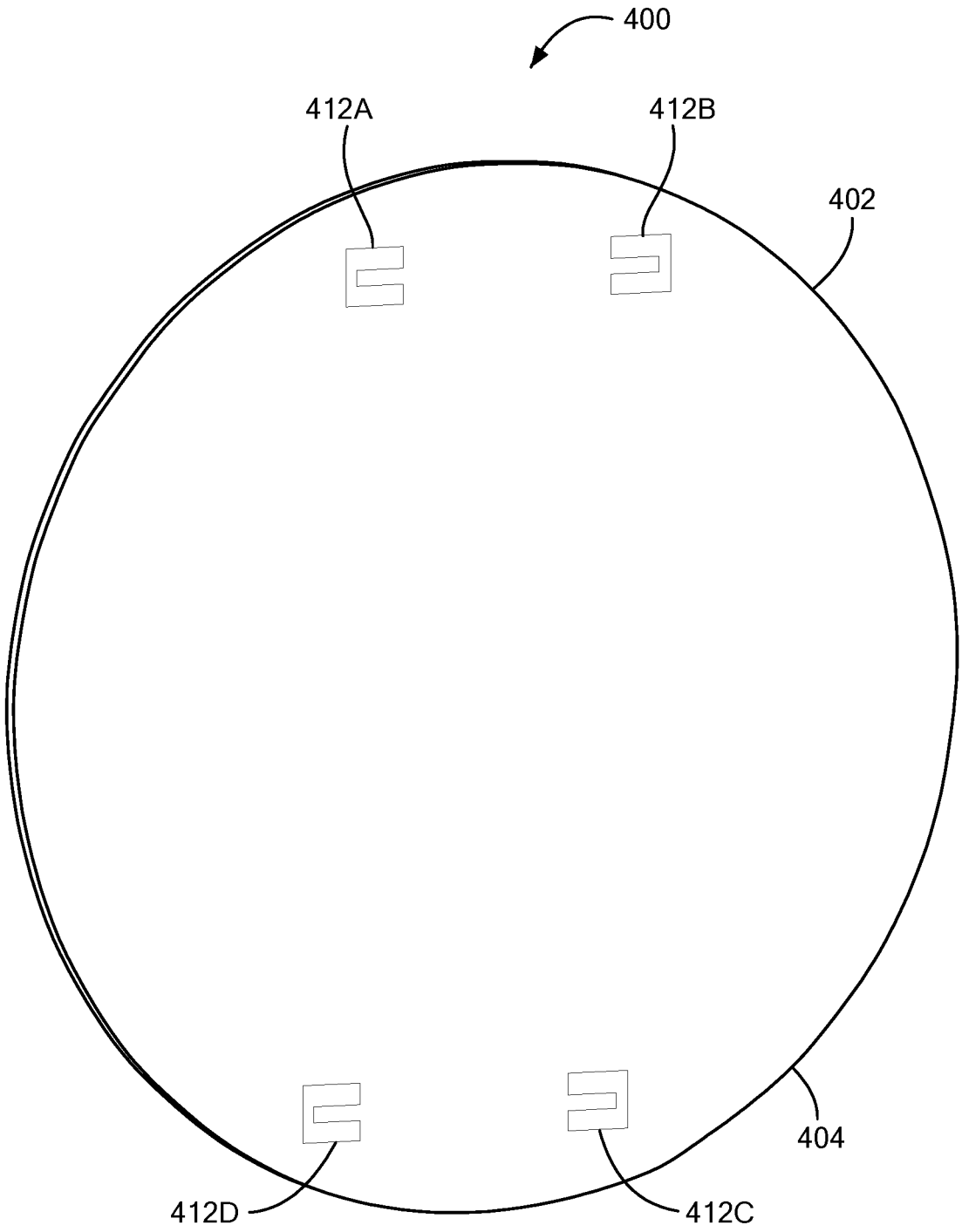
FIG. 4 is a top view of an output coupling later for a substrate integrated waveguide monopulse antenna system, according to some embodiments.

Referring now to FIG. 4, substrate integrated monopulse and antenna system 100 (FIG. 1) includes an interface substrate 400 comprising at least one slotted input/output coupler 412 provided there, and at least one port of a 90° hybrid coupler formed from conductive via holes 404 extending through substrate 402. It should be noted that in the illustrative embodiment of FIG. 4, only layers of substrate 402 including conductive via holes 404 and slotted output couplers 412 of system 400 are presented for clarity, in other embodiments, system 400 comprises a substrate integrated waveguide and antenna system such as substrate integrated waveguide and antenna system 100 presented in FIG. 1.

Each slotted output coupler 412 is provided within a second conductive layer disposed over a surface of substrate 402. According to some embodiments, the surface 402*b* of substrate 402 over which the second conductive layer is disposed is opposite and opposing to the surface 402*a* of substrate 402 over which a first conductive layer providing slotted antenna elements 108 is disposed. For example, in the illustrative embodiment of FIG. 1, slot antennas 108A-L are provided in a first conductive layer disposed over a first surface 102*a* of substrate 102 and slotted output couplers 112A-D are provided in a second conductive layer disposed over a second, opposite surface 102*b* of substrate 102.

Each slotted output coupler 412 is coupled to the monopulse circuit via at least one port of a 90° hybrid coupler. This coupling comprises a via fence formed by conductive via holes 404. For example, in the illustrative embodiment of FIG. 1, slotted output coupler 112A is coupled to a port of 90° hybrid coupler 106A. Each slotted output coupler 412 is configured to deliver electromagnetic waves to the monopulse circuit via a coupled 90° hybrid coupler 106 and receive electromagnetic waves from the monopulse circuit via a coupled 90° hybrid coupler 106.

According to some embodiments, each slotted output coupler 412 is further configured to couple with a transceiver. Each slotted output coupler 412 may couple with the transceiver via contact, wiring, wirelessly—or any combination thereof. While coupled to the transceiver, each slotted output coupler 412 is configured to receive electromagnetic waves from the transceiver and provide electromagnetic waves to the transceiver. In some embodiments, at a first time, the transceiver may generate a transmit beam to be emitted by substrate integrated monopulse and antenna system 400. The transceiver is configured to provide portions of the transmit beam to at least one slotted output coupler 412. The slotted output coupler 412 is configured to provide the portions of the transmit beam to the monopulse circuit via coupled port of a 90° hybrid coupler 106.

According to some embodiments, at a second time, at least one slotted output coupler 412 receives signals representing sum, azimuth difference, elevation difference, Q difference—or any combination thereof—from the monopulse circuit. Each slotted output coupler 412 is then configured to provide the signals to the coupled transceiver.

Referring now to FIG. 5, substrate integrated monopulse antenna system 502 is configured to couple with at least a portion of transceiver 514 via at least one slotted output coupler of substrate integrated monopulse antenna 502. In some embodiments, substrate integrated monopulse antenna system 502 may couple to at least a portion of transceiver 514 using each slotted output coupler 112, while in other embodiments fewer slotted output couplers 122 may be used. When substrate integrated monopulse and antenna system 502 is coupled to at least a portion of transceiver 514 via slotted output couplers 112, integrated monopulse antenna 502 is configured to receive at least portions of a transmit beam from transceiver 514 and provide signals representing a sum, azimuth difference, elevation difference, Q difference—or any combination thereof—to transceiver 514.

According to some embodiments, transceiver 514 comprises a first surface and a second, opposing surface with a thickness between the two surfaces. In some embodiments, substrate integrated monopulse antenna 502 is configured so that when coupled to at least a portion of transceiver 514 via slotted output couplers, a surface of substrate integrated monopulse and antenna system 502 lies flat on at least a portion of a surface of transceiver 514. In other embodiments, the entirety of one surface of substrate integrate monopulse antenna system 502 is in continuous contact with at least a portion of a surface of transceiver 514, while in other embodiments at least a portion of a surface of the substrate integrated monopulse antenna system 502 is in continuous contact with a surface of transceiver 514. In the illustrate embodiment of FIG. 5, substrate integrated monopulse antenna system 502 lies flat on a surface of transceiver 514 with a surface of system 502 being in continuous contact with a surface of transceiver 514.

In some embodiments, substrate integrated monopulse antenna system 502 is configured to couple to at least a portion of transceiver 514 directly without the use of external connectors, cable, wires, or any combination thereof.

Figure 6:
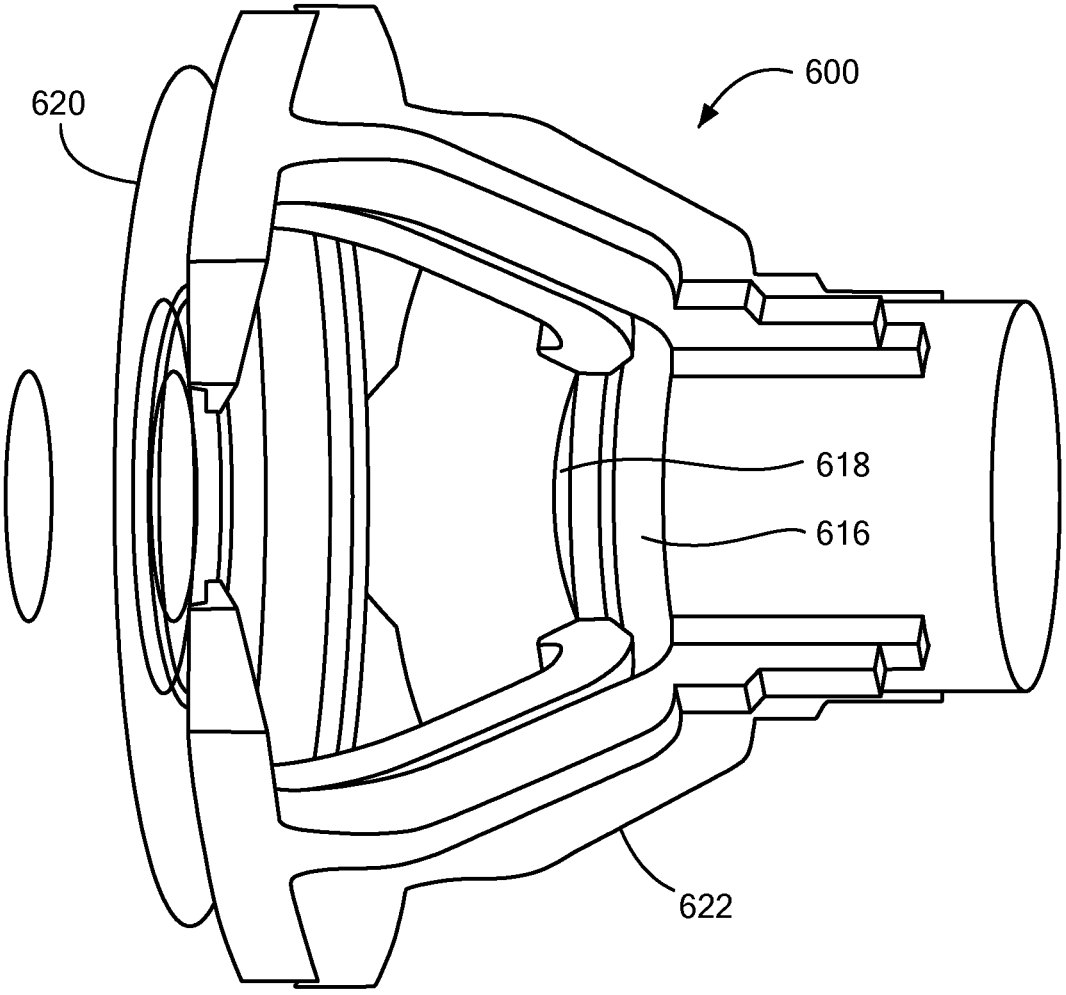
FIG. 6 is a diagram depicting an exemplary seeker antenna, according to some embodiments.

Referring now to FIG. 6, FIG. 6 illustrates an exemplary embodiment of a seeker antenna 600 comprising slot antennas 618. Seeker antenna 600 comprises dish 620, dichroic lens 618, slot antennas 616, and housing 622. Housing 622 encases seeker antenna 600 and may comprises a plastic, metal, alloy, carbon, dielectric material, or any combination thereof—to name a few examples.

According to some embodiments, substrate integrated waveguide and monopulse antenna system 100 may be configured to receive signals from antennas 616 of seeker antenna 600 so that antennas 616 are provided in a conductive layer disposed over a first surface of substrate 102. In other words, antennas 616 of seeker antenna 600 may comprise slot antennas 116 of substrate integrated waveguide monopulse and antenna system 100. Portions of a desired radiation pattern transmitted by antennas 616 pass through dichroic lens 618 and are collected by dish 620 to form the desired radiation pattern. The dichroic lens 618 may be an optional element. For example, the dichroic lens can be used in aperture systems having a common dish that collects energy for multiple sensors, e.g., radar and infrared. In such embodiments, the dichroic lens 618 separates and distributes appropriate portions of the received signals to appropriate sensors. Dichroic lens 618 comprises a dichroic material that acts as a filter when portions of the desired radiation pattern are passed through. Further, dish 620 is configured to receive echoes that are passed through dichroic lens 618 and delivered to slot antennas 618.

In embodiments, the seeker antenna 600 can be used to transmit radio frequency energy and subsequently collect returning energy from that transmission that has been reflected by target like objects. A monopulse comparator (not shown) of the antenna a system 100 divides the antenna into four quadrants, then combines and compares the detected signals in four ways: 1) summation of the four quadrants (e.g., upper, lower, left, and right), 2) difference between upper and lower quadrants, 3) difference between left and right quadrants, and 4) a diagonal difference of the quadrants. These signals are then directed to a receiver and processor in order to determine a relative target angle and distance.

As used herein, the term "waveguide" is used to describe any system of material boundaries or structures for guiding electromagnetic waves.

As used herein, the term "conductive via hole" (or "conductive vias" or more simply a "via") is used to describe a signal path with extends through (rather than along a surface of) one or more circuit boards or through an entire substrate to electrically connect conductors (e.g. ground planes on opposing sides of a substrate). In embodiments to be described hereinbelow, a conductive via hole passes through a first conductive layer disposed over a first surface of a substrate and terminates at a second conductive layer disposed over a second surface of the substrate.

It should also be appreciated that, as used herein, relational terms, such as "first," "second," "top," "bottom," "left," "right," and the like, may be used to distinguish one element or portion(s) of an element from another element or portion(s) of the element without necessarily requiring or implying any physical or logical relationship or order between such elements.

Comprise, include, and/or plural forms of each are open ended and include the listed parts and can include additional parts that are not listed. And/or is open ended and includes one or more of the listed parts and combinations of the listed parts.

One skilled in the art will realize the invention may be embodied in other specific forms without departing from the spirit or essential characteristics thereof. The foregoing embodiments are therefore to be considered in all respects illustrative rather than limiting of the invention described herein. Scope of the invention is thus indicated by the appended claims, rather than by the foregoing description, and all changes that come within the meaning and range of equivalency of the claims are therefore intended to be embraced therein.

What is claimed is:

1. A substrate integrated waveguide monopulse antenna, comprising:

a substrate; a first conductor disposed on the first surface of the substrate;

a plurality of antenna elements provided on the first surface of the substrate;

a second conductor disposed on the second surface of the substrate;

a plurality of conductive via holes extending through said substrate and extending between the first and second surfaces, with some of the plurality of conductive via holes arranged to form a plurality of resonant cavities and with some of the plurality of conductive via holes arranged to form a plurality of hybrid couplers with at least one resonant cavity coupled to each of the antenna elements; the plurality of hybrid couplers provided within the substrate and around a perimeter of the substrate, wherein two of the plurality of resonant cavities are coupled to at least one port of the plurality of hybrid couplers; and a plurality of output couplers provided on the second surface of the substrate.

2. The substrate integrated waveguide monopulse antenna of claim 1, wherein:

the first conductor on the first surface of said substrate corresponds to a conductive layer disposed on the first surface of said substrate; and the plurality of antenna elements are provided as slot antenna elements formed in the first conductive layer.

3. The substrate integrated waveguide monopulse antenna of claim 1, wherein:

the plurality of output couplers are slotted output couplers; and the second conductor on the second surface of the substrate corresponds to a ground plane layer.

4. The substrate integrated waveguide monopulse antenna of claim 1, wherein each output coupler is coupled to at least one port of said plurality of hybrid couplers.

5. The substrate integrated waveguide monopulse antenna of claim 1, further comprising a transceiver, the transceiver having first and second opposing surfaces, wherein at least a portion of the first surface of the transceiver is configured to couple to at least one of the plurality of output couplers.

6. The substrate integrated waveguide monopulse antenna of claim 5, wherein the second surface of substrate is configured to lie flat on the first surface of the transceiver when the at least said portion of the first surface of the transceiver is coupled to said at least one of the plurality of output couplers.

7. The substrate integrated waveguide monopulse antenna of claim 5, wherein the transceiver is disposed under the second surface of the substrate.

8. The substrate integrated waveguide monopulse antenna of claim 2, wherein the plurality of slot antenna elements includes a plurality of dogbone couplers.

9. A substrate integrated waveguide monopulse antenna, comprising:

a substrate having first and second opposing surfaces, wherein a first side of the substrate is configured to couple with a seeker antenna comprising a plurality of slot antennas:

a first conductive layer disposed on the first surface of said substrate and configured to receive the plurality of slot antenna elements:

a second conductive layer disposed on the second surface of said substrate;

a plurality of conductive via holes extending through said substrate and extending between the first and second conductive layers, with some of said plurality of via holes arranged to form a plurality of resonant cavities and with some of the plurality of conductive via holes arranged to form a plurality of hybrid couplers, with at least one resonant cavity configured to couple signals between at least one said slot antenna elements and at least one hybrid coupler and wherein each of the hybrid couplers are disposed around a perimeter of said substrate;

and a plurality of slotted output couplers provided, in the second conductive layer;

wherein two of the plurality of resonant cavities are coupled to at least one part of said plurality of hybrid couplers.

10. The substrate integrated waveguide monopulse antenna of claim 9, wherein each slotted output coupler is coupled to at least one port of said plurality of hybrid couplers.

11. The substrate integrated waveguide monopuise antenna of claim 9, further comprising a transceiver, the transceiver having first and second opposing surfaces, wherein at least a portion of the first surface of the transceiver is configured to couple to at least one of the plurality of slotted output couplers.

12. The substrate integrated waveguide monopulse antenna of claim 11, wherein the second surface of substrate is configured to lie flat on the first surface of the transceiver when the at least said portion of the first surface of the transceiver is coupled to said at least one of the plurality of slotted output couplers.

13. The substrate integrated waveguide monopulse antenna of claim 11, wherein the transceiver is disposed under the second surface of the substrate.

14. The substrate integrated waveguide antenna of claim 9, wherein the seeker antenna further comprises a dichroic lens and a dish.

15. A substrate integrated waveguide monopulse antenna, comprising:

a substrate having first and second opposing surfaces;

a first conductive layer disposed on the first surface of said substrate;

a plurality of slot antenna elements provided in the first conductive layer;

a second conductive layer disposed on the second surface of said substrate; and a plurality of conductive via holes extending through said substrate and extending between the first and second conductive layers, said plurality of conductive via holes arranged to form a plurality of resonant cavities and a plurality of hybrid couplers, wherein said plurality of conductive via holes are further arranged to couple at least one resonant cavity to at least one port of a hybrid coupler.

16. The substrate integrated waveguide monopulse antenna of claim 15, wherein a plurality of slotted output couplers is provided in the second conductive layer.

17. The substrate integrated waveguide monopulse of claim 16, wherein said plurality of conductive via holes are further arranged to couple at least one slotted output coupler to at least one other port of a hybrid coupler.

18. The substrate integrated waveguide monopulse antenna of claim 15, further comprising a transceiver, the transceiver having first and second opposing surfaces, wherein at least a portion of the first surface of the transceiver is configured to couple to at least one of the plurality of slotted output couplers.

19. The substrate integrated waveguide monopulse antenna of claim 18, wherein the second surface of substrate is configured to lie flat on the first surface of the transceiver when the at least said portion of the first surface of the transceiver is coupled to said at least one of the plurality of slotted output couplers.

20. The substrate integrated waveguide monopulse antenna of claim 18, wherein the transceiver is disposed under the second surface of the substrate.

* * * * *